US011634858B2

(12) United States Patent
Wang et al.

(10) Patent No.: US 11,634,858 B2
(45) Date of Patent: Apr. 25, 2023

(54) METHOD FOR FIBER MODIFICATION

(71) Applicant: White Factor International Limited, Tortola (VG)

(72) Inventors: Han-Po Wang, Taipei (TW); Hsiang-En Tseng, New Taipei (TW)

(73) Assignee: WHITE FACTOR INTERNATIONAL LIMITED, Tortola (VG)

( * ) Notice: Subject to any disclaimer, the term of this patent is extended or adjusted under 35 U.S.C. 154(b) by 48 days.

(21) Appl. No.: 17/318,124

(22) Filed: May 12, 2021

(65) Prior Publication Data

US 2022/0364299 A1 Nov. 17, 2022

(51) Int. Cl.

| | |
|---|---|
| ***D06M 11/24*** | (2006.01) |
| *D06M 101/32* | (2006.01) |
| *D06M 101/08* | (2006.01) |
| *D06M 101/20* | (2006.01) |

(52) U.S. Cl.

CPC ..... *D06M 11/24* (2013.01); *D06M 2101/08* (2013.01); *D06M 2101/20* (2013.01); *D06M 2101/32* (2013.01); *D06M 2200/00* (2013.01)

(58) Field of Classification Search

CPC ..... D06M 11/24; D06M 2101/08; D06M 2101/20; D06M 2101/32; D06M 2200/00

See application file for complete search history.

(56) References Cited

U.S. PATENT DOCUMENTS

| | | | | |
|---|---|---|---|---|
| 2,020,437 | A * | 11/1935 | Smith | 8/2 |
| 2003/0064645 | A1* | 4/2003 | Worley | A01N 25/10 523/122 |
| 2015/0119245 | A1* | 4/2015 | Robertson, Jr. | A01N 59/00 424/661 |
| 2019/0255203 | A1* | 8/2019 | Fukuzaki | A61P 31/00 |

FOREIGN PATENT DOCUMENTS

| | | | | |
|---|---|---|---|---|
| CN | 110396813 | * | 11/2019 | D06L 4/23 |
| CN | 110424164 | * | 11/2019 | D06L 4/23 |
| JP | 2018168486 | * | 11/2018 | A41D 31/00 |

* cited by examiner

*Primary Examiner* — Amina S Khan

(74) *Attorney, Agent, or Firm* — WPAT, PC

(57) ABSTRACT

A method for fiber modification provided in the present disclosure comprises the following steps: reacting fibers with a hypochlorous acid oxidant for development of anti-oxidant fibers, separating the antioxidant fibers from the hypochlorous acid oxidant and drying the antioxidant fibers to develop modified fibers which feature better oxidation resistance.

8 Claims, 3 Drawing Sheets

METHOD FOR FIBER MODIFICATION

BACKGROUND OF THE INVENTION

Field of the Invention

The present application relates to the field of fiber modification, particularly a method for fiber modification with which oxidation resistance of fibers is promoted.

Description of the Prior Art

The hypochlorous acid as a known ingredient for the anti-microbial function is used to kill microbes such as viruses, bacteria and fungi in a variety of environments. When a human body is invaded by pathogenic germs from outside, the ingredient of hypochlorous acid generated by leucocytes of the body's immune system will react and resist these bacteria or virus, that is, proteases on cell membranes of bacteria or virus are particularly destroyed through development of resistance for annihilation of bacteria or virus. With the same function in the human body or the so-called biocompatibility, the hypochlorous acid resisting bacteria effectively is nontoxic and harmless to the human body.

However, the hypochlorous acid which is an effective and nonhazardous sterilizing agent is a strong oxidant with the drawback of poor stability in storage and seldom added in commercially available tissues in which alcohol as a principal sterilizing ingredient is mixed generally. In the other hand, the common plastic fibers such as polyethylene (PE), polyethylene terephthalate (PET), polypropylene (PP) and rayon fall short of good oxidation resistance and lose bactericidal power after a certain period of time as the hypochlorous acid.

SUMMARY OF THE INVENTION

In the present disclosure, oxidation resistance of plastic nonwoven fabrics or fibers is promoted through fiber modification hereinafter.

A method for fiber modification in the present disclosure comprises steps: fibers react with an oxidant for development of antioxidant fibers; separate the antioxidant fibers from the oxidant; dry the antioxidant fibers for development of modified fibers.

In a method for fiber modification, the fibers are selected from one of PET, PP and Rayon or a combination of at least two thereof.

In a method for fiber modification, the concentration of the oxidant ranges from 150 to 20,000 ppm.

In a method for fiber modification, the concentration of the oxidant ranges from 150 to 250 ppm preferably.

In a method for fiber modification, the oxidant is a hypochlorous acid oxidant.

In a method for fiber modification, the hypochlorous acid oxidant is selected from one of sodium hypochlorite, hypochlorous acid, calcium hypochlorite, magnesium hypochlorite and potassium hypochlorite or a combination of at least two thereof.

In a method for fiber modification, the temperature of the reaction between the fibers and the oxidant ranges from 25 to 100° C.

In a method for fiber modification, the temperature of the reaction between the fibers and the oxidant ranges from 50 to 80° C. preferably.

In a method for fiber modification, the duration of the reaction between the fibers and the oxidant ranges from 2 to 168 hours.

In a method for fiber modification, the duration of the reaction between the fibers and the oxidant ranges from 24 to 168 hours preferably.

For promotion of oxidation resistance of plastic nonwoven fabrics or fibers, plastic fibers in the present disclosure are modified such that hypochlorous acids are stored in the plastic fibers optimally and added in tissues for sterilization and cleaning effects after long-term storage.

A method for fiber modification is further explained hereinafter through embodiments for clear understanding of purposes, technical measures and advantages. It should be reiterated that embodiments in the present disclosure are used to explain rather than restrict a method for fiber modification.

BRIEF DESCRIPTION OF THE DRAWINGS

The techniques of present invention would be more understandable from the detailed description given herein below and the accompanying figures are provided for better illustration, and thus description and figures are not limitative for present invention, and wherein.

DETAILED DESCRIPTION OF THE INVENTION

Figure 1:
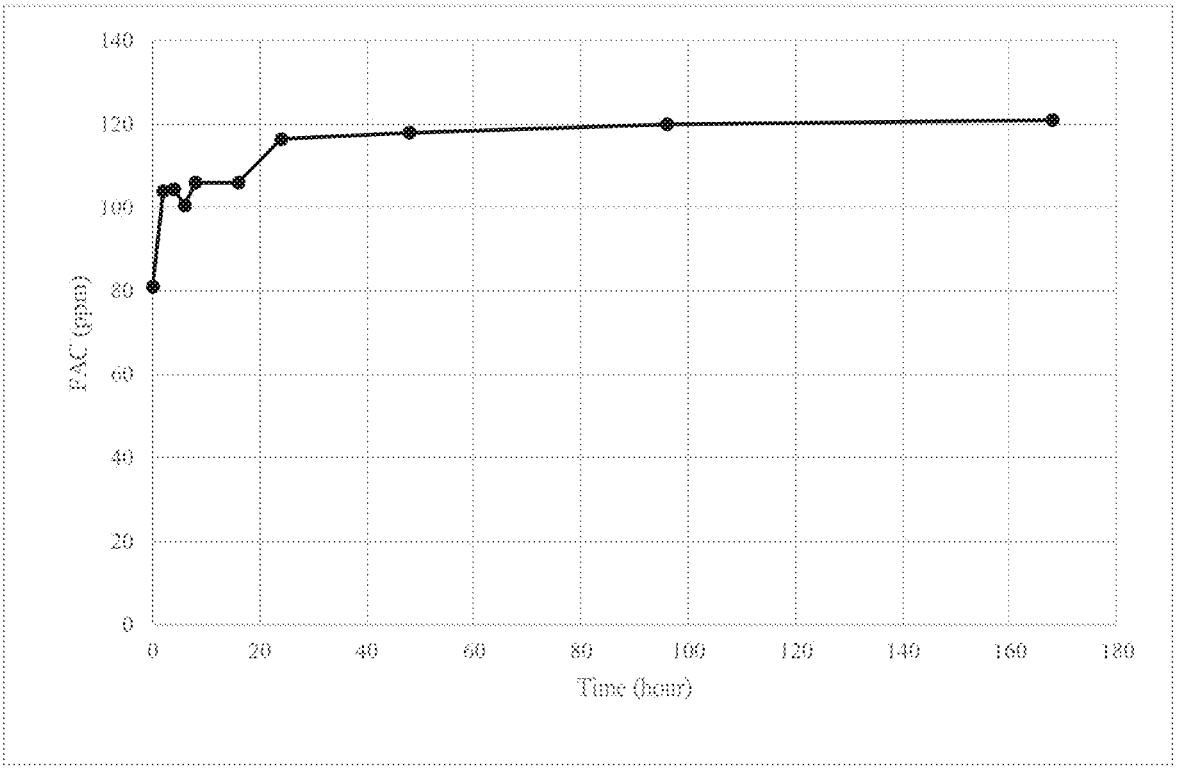
FIG. 1 illustrates test results for the storage stability of hypochlorous acids in a thermal aging test.

A method for fiber modification is explained hereinafter through test data in the example comparison and embodiments for clear understanding of technical features, content, advantages and efficiency by patent examiners.

For clear descriptions of differences in the example comparison and embodiments, the sterilization effect in the present disclosure is indicated by measurement of free available chlorine (FAC), which is used to access fibers modified according to a method for fiber modification, wherein the content of FAC comprises hypochlorous acid and hypochlorite.

For that matter, a person with general knowledge in the art is conscious of the fact that the higher content of FAC marked with parts per million (ppm) contributes to the better sterilization effect of a substance.

In the test for the storage stability of a determinand stored for a long period of time, the content of FAC, which is represented by ppm, after long-term storage is compared with the initial content of FAC and the ratio of both FACs is indicated as percentage (%) wherein a higher percentage means more FAC preserved for better efficiency.

In the present disclosure, storage stabilities of different hypochlorous acids added in fibers for a long period of time are tested in a high-temperature environment through which an environment for long-term storage at room temperature is simulated.

In the test to check the storage stability of hypochlorous acids, a determinand is placed in a glass bottle containing hypochlorous acid solvents (FAC=200 ppm) and equipped with a PP (polypropylene) cap and stored in an oven at 54° C. for 7 to 14 days based on test parameters to simulate storage status for 6 to 12 months at room temperature and check the storage stability of hypochlorous acids.

Example Comparison 1

The content of FAC in a piece of commercially available tissue containing hypochlorous acids as the principal component is measured and presented in Table 1 which indicates residual hypochlorous acids in all products and ultra-low FAC inside these commercially available tissues containing hypochlorous acids. As shown in data of FAC, each of commercially available tissues containing hypochlorous acids which have been transported, stored and finally purchased by consumers is characteristic of the ultra-low content of hypochlorous acids and the drawback of poor stability of hypochlorous acids in stored tissues.

TABLE 1 checks for FAC in commercially available tissues containing hypochlorous acids

| Sample | Content of FAC (ppm) | pH | Days of storage |
|---|---|---|---|
| Tissue A | 1.00 | 8.2 | 31 days |
| Tissue B | 5.32 | 6.6 | 156 days |
| Tissue C | 0 | 4.87 | 275 days |

The storage stabilities of hypochlorous acids in plastic non-woven fabrics based on common macromolecular polymers, e.g., PET, PP and Rayon, are shown in Table 2 which indicates poor storage stabilities of hypochlorous acids inside plastic non-woven fabrics.

TABLE 2 storage stabilities of hypochlorous acids inside common plastic non-woven fabrics

| Sample | Preservation of FAC (%) | pH | Days of storage |
|---|---|---|---|
| Rayon | 3.5 | 3.15 | 1 day |
| PP | 0.0 | 3.69 | 1 day |
| PET | 15.9 | 5.50 | 30 days |

Embodiment 1

The steps to modify plastic non-woven fabrics through hypochlorous acids are shown as follows:

S0101: Put plastic non-woven fabrics inside a glass bottle and store the bottle in a thermostatic chamber;

S0102: Add hypochlorous acid solutions (20 times the weight of non-woven fabrics (pH=6.5; FAC=200 ppm)) into the bottle;

S0103: Keep temperature of the bottle at 54° C. for a 14-day reaction during which fibers react with the hypochlorous acid solutions for development of modified fibers;

S0104: Remove plastic non-woven fabrics for rinsing and drying after completion of the reaction.

The method to test storage stabilities of hypochlorous acids is shown as follows:

S0201: Seal each sample in a glass bottle (100 mL) equipped with a PP cap and add hypochlorous acid solutions (20 times the weight of non-woven fabrics (pH=6.5; FAC=200 ppm)) into the bottle;

S0202: Keep the sample in an environment at 54° C. for 7 days;

S0203: Make measurements for pH and FAC after 7 days to check improvement of the storage stability of hypochlorous acids in a modified sample.

As shown in Table 3, the storage stability of hypochlorous acids in modified plastic non-woven fabrics is 1.5 times better than that of hypochlorous acids in unmodified non-woven fabrics. Thus, it can be seen that the storage stability of hypochlorous acids in fabrics treated with a method for fiber modification is promoted and significantly effective.

TABLE 3 storage stabilities of hypochlorous acids in unmodified and modified non-woven fabrics

| Sample | Preservation of FAC (%) | pH |
|---|---|---|
| Non-woven fabrics (unmodified) | 41.5 ± 0.015 | 5.28 |
| Non-woven fabrics (modified) | 66.0 ± 0.005 | 6.07 |

Embodiment 2

The steps to test storage stabilities of hypochlorous acids in unmodified and modified non-woven fabrics (PET) are shown as follows:

S0301: Put non-woven fabrics and modified non-woven fabrics inside glass bottles (100 mL) equipped with PP caps and add hypochlorous acid solutions (20 times the weight of non-woven fabrics (pH=6.19; FAC=172.7 ppm)) for the 14-day thermal aging reaction at 54° C., respectively;

S0302: Make measurements for pH and FAC after completion of the 14-day reaction.

As shown in Table 4, the storage stability of hypochlorous acids in modified non-woven fabrics is twice better than that of hypochlorous acids in unmodified non-woven fabrics.

TABLE 4 storage stabilities of hypochlorous acids in unmodified and modified non-woven fabrics

| | Content of FAC (ppm) | | Preservation of FAC (%) | pH | |
|---|---|---|---|---|---|
| | 0 | After 14 days | | 0 | After 14 days |
| Non-woven fabrics (modified) | 172.7 | 99.0 | 57.32% | 6.19 | 3.74 |
| Non-woven fabrics (unmodified) | 172.7 | 47.5 | 27.50% | 6.19 | 3.48 |

Embodiment 3

The steps to test storage stabilities of hypochlorous acids in unmodified PET fabrics are shown as follows:

S0401: Seal unmodified PET fibers in a glass bottle (100 mL) equipped with a PP cap and add hypochlorous acid solutions (weight=20 times the weight of PET fibers; pH=6.47; FAC=200 ppm)) for a 7-day thermal aging reaction at 54° C.;

S0402: Make measurements for pH and FAC after the 7-day reaction.

As shown in Table 5, the storage stabilities of hypochlorous acids in unmodified PET fabrics are unsatisfactory after the 7-day reaction at 54° C.: the concentrations of residual FAC are 26 ppm and 68 ppm, respectively; the residues of hypochlorous acids are 13.0% and 34.0%, respectively.

TABLE 5 storage stabilities of hypochlorous acids in unmodified fibers

| | Content of FAC (ppm) | | | pH | |
|---|---|---|---|---|---|
| | 0 | After 7 days | Preservation of FAC (%) | 0 | After 7 days |
| Fabric 1 (unmodified) | 200 | 26.0 | 13.% | 6.47 | 3.06 |
| Fabric 2 (unmodified) | 200 | 68.0 | 34% | 6.47 | 3.66 |

Note:
Fabric 1 and Fabric 2 are PET fabrics with different specifications, respectively.

Embodiment 4

The steps to test storage stabilities of hypochlorous acids are shown as follows:

S0501: Seal modified antioxidant PET fibers in a glass bottle (100 mL) equipped with a PP cap and add hypochlorous acid solutions (20 times the weight of PET fibers; pH=6.54; FAC=210 ppm)) for a 14-day thermal aging reaction at 54° C.;

S0502: Make measurements for pH and FAC after completion of the 14-day reaction.

As shown in Table 6, the residues of hypochlorous acids are 52.9% and 50.95%, respectively. The content of FAC in modified PET fabrics is better than before and the storage stability of hypochlorous acids in modified PET fabrics is promoted.

TABLE 6 storage stabilities of hypochlorous acids in modified fibers

| | Content of FAC (ppm) | | | pH | |
|---|---|---|---|---|---|
| | 0 | After 14 days | Preservation of FAC (%) | 0 | After 14 days |
| Fabric 1 (modified) | 210 | 111 | 52.86% | 6.54 | 5.73 |
| Fabric 2 (modified) | 210 | 107 | 50.95% | 6.54 | 5.67 |

Note:
Fabric 1 and Fabric 2 are PET fabrics with different specifications, respectively.

Embodiment 5

The steps to optimize the duration of modification treatment of non-woven fabrics (PET) are shown as follows:

S0601: Put plastic non-woven fabrics inside a glass bottle and add hypochlorous acid solutions (weight=80 times the weight of non-woven fabrics; pH=6.5; FAC=200 ppm) into the bottle for 1, 2, 3, 5, 7, 11 and 14-day reactions at 54° C.;

S0602: Remove plastic non-woven fabrics for rinsing, drying and storage after completion of reactions.

The method to test storage stabilities of hypochlorous acids is shown as follows:

S0603: Seal modified fabrics (PET) in a glass bottle (100 mL) equipped with a PP cap and add hypochlorous acid solutions (weight=20 times the weight of modified fabrics; pH=6.26; FAC=203 ppm) into the bottle for a 14-day thermal aging reaction at 54° C.;

S0604: Make measurements for pH and FAC after completion of the 14-day reaction.

As shown in Table 7, there is no significant difference in data among fabrics modified from 1 day to 14 days, that is, the compatibility of plastic non-woven fabrics with hypochlorous acids is promoted after 1-day modification treatment at 54° C. Therefore, the duration of modification treatment at 54° C. is one day for optimal time cost.

TABLE 7 test results of a thermal aging reaction for storage stabilities of hypochlorous acids in non-woven fabrics undergoing different durations of modification treatment

| Duration of modification treatment Day | Content of FAC (ppm) 0 | After 14 days at 54° C. | Preservation of FAC (%) | pH 0 | After 14 days at 54° C. |
|---|---|---|---|---|---|
| 1 | 203 | 101.0 | 49.75% | 6.26 | 5.77 |
| 2 | 203 | 93.0 | 45.81% | 6.26 | 5.59 |
| 3 | 203 | 101.5 | 50.00% | 6.26 | 5.72 |
| 5 | 203 | 94.5 | 46.55% | 6.26 | 5.43 |
| 7 | 203 | 99.5 | 49.01% | 6.26 | 5.39 |
| 11 | 203 | 93.5 | 46.06% | 6.26 | 5.34 |
| 14 | 203 | 101.0 | 49.75% | 6.26 | 5.50 |

Embodiment 6

The steps to optimize the duration of modification treatment of fabrics (PET) are shown as follows:

S0701: Put plastic fabrics in a glass bottle and add hypochlorous acid solutions (weight=20 times the weight of plastic fabrics; pH=6.5; FAC=200 ppm) into the bottle for 0, 2, 4, 6, 8, 16, 24, 48, 96 and 168-hour reactions at 54° C.;

S0702: Remove plastic fabrics for rinsing, drying and storage after completion of reactions.

The method to test storage stabilities of hypochlorous acids is shown as follows:

S0703: Seal modified fabrics (PET) in a glass bottle (100 mL) equipped with a PP cap and add hypochlorous acid solutions (weight=20 times the weight of modified fabrics; pH=6.37; FAC=216 ppm) into the bottle for a 14-day thermal aging reaction at 54° C.;

S0704: Make measurements for pH and FAC after completion of the 14-day reaction.

As shown in Table 8 and FIG. 1, the storage stability of hypochlorous acids in fibers modified for not more than 24 hours is promoted with the duration of modification treatment. Moreover, the storage stability of hypochlorous acids in fibers is maximized at 24 hours (1 day) but not further promoted with an extended duration of modification treatment. That is, the compatibility of hypochlorous acids with plastic non-woven fabrics modified for one day at 54° C. is fulfilled for optimal time cost.

TABLE 8 test results of thermal aging reactions for storage stabilities of hypochlorous acids in non-woven fabrics undergoing different durations of modification treatment

| Duration of modification treatment Hour | Content of FAC (ppm) 0 | After 14 days at 54° C. | Preservation of FAC (%) | pH 0 | After 14 days at 54° C. |
|---|---|---|---|---|---|
| 0 | 216 | 81.0 | 37.50% | 6.37 | 4.44 |
| 2 | 216 | 104.0 | 48.15% | 6.37 | 4.94 |
| 4 | 216 | 104.5 | 48.38% | 6.37 | 4.96 |
| 6 | 216 | 100.5 | 46.53% | 6.37 | 5.13 |
| 8 | 216 | 106.0 | 49.07% | 6.37 | 5.28 |
| 16 | 216 | 106.0 | 49.07% | 6.37 | 5.21 |
| 24 | 216 | 116.5 | 53.94% | 6.37 | 5.39 |
| 48 | 216 | 118.0 | 54.63% | 6.37 | 5.46 |
| 96 | 216 | 120.0 | 55.56% | 6.37 | 5.46 |
| 168 | 216 | 121.0 | 56.02% | 6.37 | 5.50 |

Embodiment 7

The steps to optimize the duration of modification treatment for non-woven fabrics (PET) at room temperature are shown as follows:

S0801: Put plastic non-woven fabrics in a glass bottle and add hypochlorous acid solutions (weight=80 times the weight of non-woven fabrics; pH=6.5; FAC=200 ppm) into the bottle for 3, 5 and 7-day reactions at room temperature (25° C.);

S0802: Remove plastic non-woven fabrics for rinsing, drying and storage after completion of reactions.

The method to test storage stabilities of hypochlorous acids is shown as follows:

S0803: Seal modified fibers (PET) in a glass bottle (100 mL) equipped with a PP cap and add hypochlorous acid solutions (weight=20 times the weight of modified fibers) into the bottle for a 14-day thermal aging reaction at 54° C.;

S0804: Make measurements for pH and FAC after completion of the 14-day reaction.

As shown in Table 9 in which all data is summarized, the compatibility of hypochlorous acids with non-woven fabrics modified at room temperature is promoted but not as good as that of hypochlorous acids with non-woven fabrics modified at higher temperature. Thus, the optimal solution is modification treatment of non-woven fabrics modified at 54° C.

TABLE 9 test results of the thermal aging reaction for storage stabilities of hypochlorous acids in non-woven fabrics undergoing different conditions of modification treatment

| Treatment condition Day | Content of FAC (ppm) 0 | After 14 days at 54° C. | Preservation of FAC (%) | pH 0 | After 14 days at 54° C. |
|---|---|---|---|---|---|
| Unmodified | 190 | 47.5 | 27.50% | 6.19 | 3.48 |
| After 3 days at 25° C. | 231 | 97.0 | 42.00% | 6.50 | 5.77 |
| After 5 days at 25° C. | 231 | 95.0 | 41.12% | 6.50 | 5.59 |
| After 7 days at 25° C. | 231 | 95.0 | 41.26% | 6.50 | 5.72 |
| After 14 days at 54° C. | 231 | 113.0 | 48.70% | 6.50 | 5.50 |

Embodiment 8

The steps to optimize the duration of modification treatment for non-woven fabrics (PET) modified at 70° C. are shown as follows:

S0901: Put plastic non-woven fabrics in a glass bottle and add hypochlorous acid solutions (weight=80 times the weight of non-woven fabrics; pH=6.5; FAC=200 ppm) into the bottle for 0, 2, 4, 8, 16 and 24-hour reactions at 70° C.;

S0902: Remove plastic non-woven fabrics after 0, 2, 4, 8, 16 and 24 hours for rinsing, drying and storage.

The method to test storage stabilities of hypochlorous acids is shown as follows:

S0903: Seal modified non-woven fabrics (PET) in a glass bottle (100 mL) equipped with a PP cap and add hypochlorous acid solutions (weight=20 times the weight of modified non-woven fabrics; pH=6.45; FAC=221 ppm)) into the bottle for a 14-day thermal aging reaction at 54° C.;

S0904: Make measurements for pH and FAC after completion of the 14-day reaction.

Figure 2:
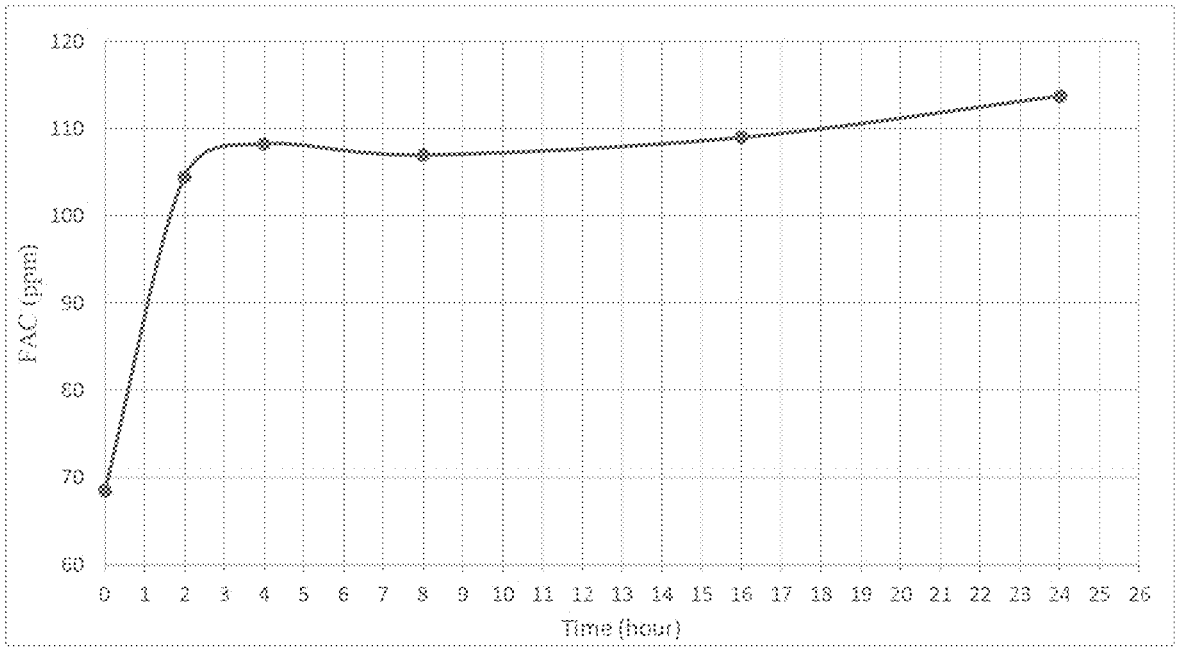
FIG. 2 illustrates test results for the storage stability of hypochlorous acids in a thermal aging test.

As shown in Table 10 and FIG. 2, the storage stability of hypochlorous acids is promoted with an extended duration of modification treatment within 24 hours and the storage stability of hypochlorous acids in non-woven fabrics modified for over two hours at 70° C. is significantly promoted.

TABLE 10 test results for storage stabilities of hypochlorous acids modified for different durations of modification treatment at 70° C.

| Duration of modification treatment (Hour) | Content of FAC (ppm) 0 | Content of FAC (ppm) After 14 days at 54° C. | Preservation of FAC (%) | pH 0 | pH After 14 days at 54° C. |
|---|---|---|---|---|---|
| 0 | 221 | 68.5 | 31.00% | 6.45 | 4.02 |
| 2 | 221 | 104.5 | 47.29% | 6.45 | 5.13 |
| 4 | 221 | 108.25 | 48.98% | 6.45 | 5.29 |
| 8 | 221 | 107 | 48.42% | 6.45 | 5.26 |
| 16 | 221 | 109 | 49.32% | 6.45 | 5.32 |
| 24 | 221 | 113.75 | 51.47% | 6.45 | 5.39 |

Embodiment 9

The steps for preparation of the experiment of modified non-woven fabrics and unmodified non-woven fabrics stored at room temperature are shown as follows:

S1001: Put plastic non-woven fabrics in a glass bottle and add hypochlorous acid solutions (weight=80 times the weight of non-woven fabrics; pH=6.5; FAC=200 ppm) into the bottle for a reaction at 54° C.;

S1002: Remove modified plastic non-woven fabrics after one day for rinsing, drying and storage.

The method to test storage stabilities of hypochlorous acids is shown as follows:

S1003: Add hypochlorous acid solutions (weight=15 times the weight of non-woven fabrics) into modified non-woven fabrics and unmodified non-woven fabrics for the experiment of storage at room temperature (25° C.), respectively; make measurements for pH and FAC every month to compare differences between modified non-woven fabrics and unmodified non-woven fabrics, both of which are stored at room temperature.

Figure 3:
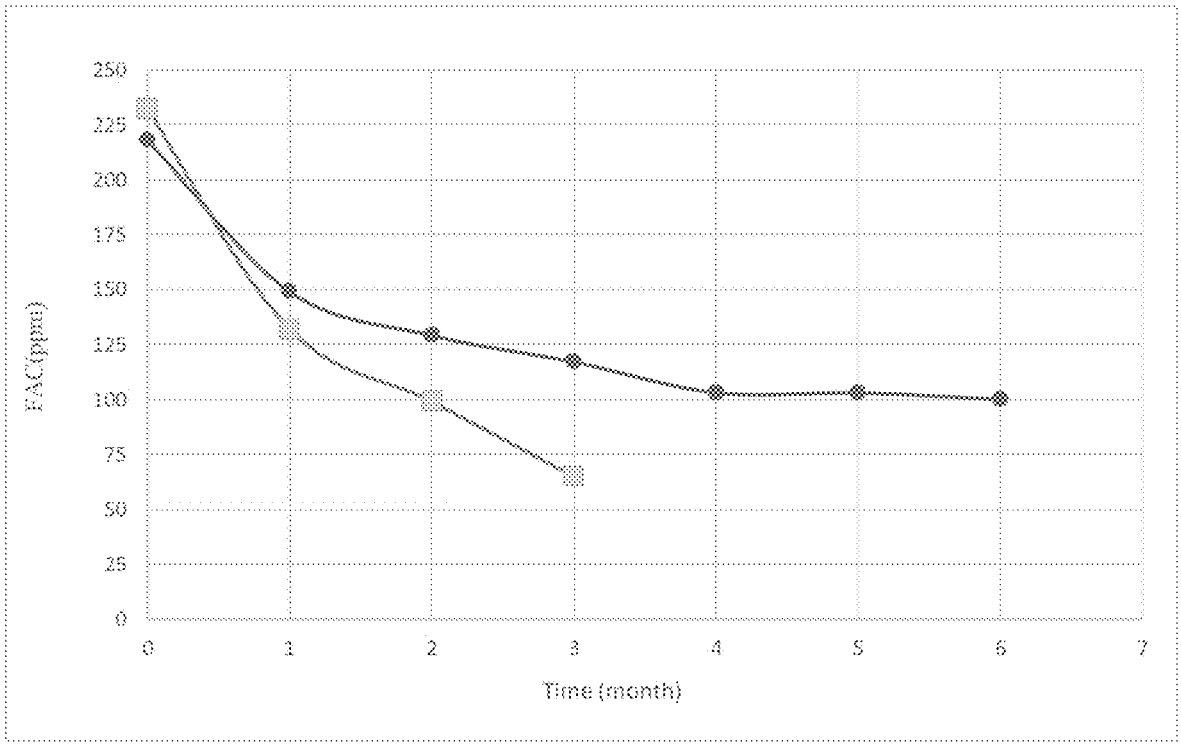
FIG. 3 illustrates test results for the storage stability of hypochlorous acids at room temperature.

As shown in Table 11 and FIG. 3 in which modified non-woven fabrics are marked by circles and unmodified non-woven fabrics are marked by squares, the storage stability of hypochlorous acids in modified non-woven fabrics is better, the pH value of hypochlorous acids at room temperature is more stable and particularly significant from the third month, and the storage stability of hypochlorous acids in modified non-woven fabrics goes up by 180% compared with the storage stability of hypochlorous acids in unmodified non-woven fabrics.

TABLE 11 test results for modified non-woven fabrics and unmodified non-woven fabrics, both of which are stored at room temperature

| Duration of storage (month) | | 0 | 1 | 2 | 3 | 4 | 5 | 6 |
|---|---|---|---|---|---|---|---|---|
| Modified non-woven fabric | Content of FAC (ppm) | 218 | 149 | 129 | 117 | 103 | 103 | 100 |
| | pH | — | 6.17 | 6.08 | 5.74 | 5.55 | 5.35 | 5.39 |
| Unmodified non-woven fabric | Content of FAC (ppm) | 232 | 132 | 99 | 65 | — | — | — |
| | pH | 6.5 | 6.2 | 5.84 | 5.18 | — | — | — |

The test results for a method of fiber modification in the present disclosure are described hereinbefore. As previously mentioned, modified fibers contribute to better storage stabilities of hypochlorous acids which still display better bactericidal power and cleaning efficiency after long-term storage. The issue of hypochlorous acids difficultly stored in fabrics in the prior art is overcome by the present invention for more applications of hypochlorous acids in fibers such as manufacture, transportation and marketing.

The above descriptions are preferable embodiments of a method for fiber modification only that should not restrict the scope of the present application in practice; any modification or equivalent replacement without departing from the spirit and scope of the present application should be incorporated in claims hereinafter.

What is claimed is:

1. A method of fiber modification for better storage stabilities of hypochlorous acids, comprising steps as follows:

i. fibers react with a hypochlorous acid oxidant for development of antioxidant fibers, wherein temperature of reaction between the fibers and the hypochlorous acid oxidant ranges from 50 to 100° C., wherein duration of the reaction between the fibers and the hypochlorous acid oxidant ranges from 2 to 336 hours;

ii. separating the antioxidant fibers from the hypochlorous acid oxidant; and iii. drying the antioxidant fibers for development of modified fibers.

2. The method of fiber modification for better storage stabilities of hypochlorous acids as claimed in claim 1 wherein the fibers are selected from one of polyethylene (PE), polyethylene terephthalate (PET), polypropylene (PP) and rayon or a combination of at least two thereof.

3. The method of fiber modification for better storage stabilities of hypochlorous acids as claimed in claim 1 wherein the concentration of the hypochlorous acid oxidant ranges from 150 to 20,000 ppm.

4. The method of fiber modification for better storage stabilities of hypochlorous acids as claimed in claim 1 wherein the concentration of the hypochlorous acid oxidant ranges from 150 to 250 ppm.

5. The method of fiber modification for better storage stabilities of hypochlorous acids as claimed in claim 1 wherein the hypochlorous acid oxidant is selected from one of sodium hypochlorite, hypochlorous acid, calcium hypochlorite, magnesium hypochlorite and potassium hypochlorite or a combination of at least two thereof.

6. The method of fiber modification for better storage stabilities of hypochlorous acids as claimed in claim 1 wherein the temperature of the reaction between the fibers and the hypochlorous acid oxidant ranges from 50 to 80° C.

7. The method of fiber modification for better storage stabilities of hypochlorous acids as claimed in claim 1 wherein the duration of the reaction between the fibers and the hypochlorous acid oxidant ranges from 2 to 168 hours.

8. The method of fiber modification for better storage stabilities of hypochlorous acids as claimed in claim 1 wherein the duration of the reaction between the fibers and the hypochlorous acid oxidant ranges from 24 to 168 hours.

* * * * *